US006930268B1

(12) United States Patent
Tuniewicz et al.

(10) Patent No.: US 6,930,268 B1
(45) Date of Patent: Aug. 16, 2005

(54) ON-OFF ELECTRICAL SWITCH HAVING QUICK MAKE-BRAKE SPRING LOADED PLUNGER MECHANISM

(76) Inventors: Robert M. Tuniewicz, 14 Remsen Ct., Mt. Sinai, NY (US) 11766; Gilbert D. Talamo, P.O. Box 434, Great River, NY (US) 11739

( * ) Notice: Subject to any disclaimer, the term of this patent is extended or adjusted under 35 U.S.C. 154(b) by 150 days.

(21) Appl. No.: 10/440,653

(22) Filed: May 19, 2003

Related U.S. Application Data

(60) Provisional application No. 60/381,683, filed on May 20, 2002.

(51) Int. Cl.[7] ..... H01H 17/02

(52) U.S. Cl. ..... 200/547; 200/550; 200/252; 200/562

(58) Field of Search ..... 200/547–550, 200/16 R–17 R, 252–253, 562–563

(56) References Cited

U.S. PATENT DOCUMENTS 3,215,800 A * 11/1965 Hurter et al. ..... 335/131
3,311,719 A * 3/1967 Vananzi ..... 200/16 C
3,728,499 A * 4/1973 Bang et al. ..... 200/16 F
4,324,958 A * 4/1982 Valleau ..... 200/16 F
4,332,987 A * 6/1982 Hoffman ..... 200/16 D
4,616,112 A * 10/1986 Galloway et al. ..... 200/5 R
4,764,745 A * 8/1988 Aoi et al. ..... 337/2
5,153,401 A * 10/1992 Tseng ..... 200/550
5,824,977 A * 10/1998 Takano et al. ..... 200/16 C

* cited by examiner

*Primary Examiner*—Richard K. Lee
(74) *Attorney, Agent, or Firm*—Richard L. Miller, Registered Patent Agent

(57) ABSTRACT

A non-fused electrical slide switch. A handle assembly is operatively connected to a base, between on and off positions, and movable relative to a cover. The base has two pair of raised landings rising above four contact strips. Each pair of raised landings are disposed between one load and one line contact strip of the four contact strips and between the one load contact strip and partitions of the base, respectively. A shoe assembly includes a pair of contact shoes and at least one pair of springs biasing the pair of contact shoes. Depending portions of each contact shoe are in direct contact with associated load and line contact strips allowing electrical communication therebetween. The two pair of raised landings prevent arcing as the handle assembly traverses the on/off positions by raising the depending portions of each contact shoe immediately after they leave contact with the associated load and line contact strips.

52 Claims, 2 Drawing Sheets

ON-OFF ELECTRICAL SWITCH HAVING QUICK MAKE-BRAKE SPRING LOADED PLUNGER MECHANISM

CROSS REFERENCE TO RELATED APPLICATIONS

The instant application is a nonprovisional application of U.S. provisional application No. 60/381,683 filed on May 20, 2002, and entitled ELECTRICAL ON/OFF SLIDE SWITCH MECHANISM, and it is respectfully requested that this application be accorded the benefit under 35 USC 119(e) of said U.S. provisional application.

BACKGROUND OF THE INVENTION

1. Field of the Invention

The present invention relates to a non-fused electrical slide switch. More particularly, the present invention relates to an on-off electrical switch having quick make-brake spring loaded plunger mechanism.

2. Description of the Prior Art

Numerous innovations for electrical switches have been provided in the prior art. Even though these innovations may be suitable for the specific individual purposes to which they address, however, they differ from the present invention as heretofore described.

SUMMARY OF THE INVENTION

ACCORDINGLY, AN OBJECT of the present invention is to provide a non-fused electrical slide switch that avoids the disadvantages of the prior art.

ANOTHER OBJECT of the present invention is to provide a non-fused electrical slide switch that is simple to use.

BRIEFLY STATED, STILL ANOTHER OBJECT of the present invention is to provide a non-fused electrical slide switch. A handle assembly is operatively connected to a base, between on and off positions, and movable relative to a cover. The base has two pair of raised landings rising above four contact strips. Each pair of raised landings are disposed between one load and one line contact strip of the four contact strips and between the one load contact strip and partitions of the base, respectively. A shoe assembly includes a pair of contact shoes and at least one pair of springs biasing the pair of contact shoes. Depending portions of each contact shoe are in direct contact with associated load and line contact strips allowing electrical communication therebetween. The two pair of raised landings prevent arcing as the handle assembly traverses the on/off positions by raising the depending portions of each contact shoe immediately after they leave contact with the associated load and line contact strips.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
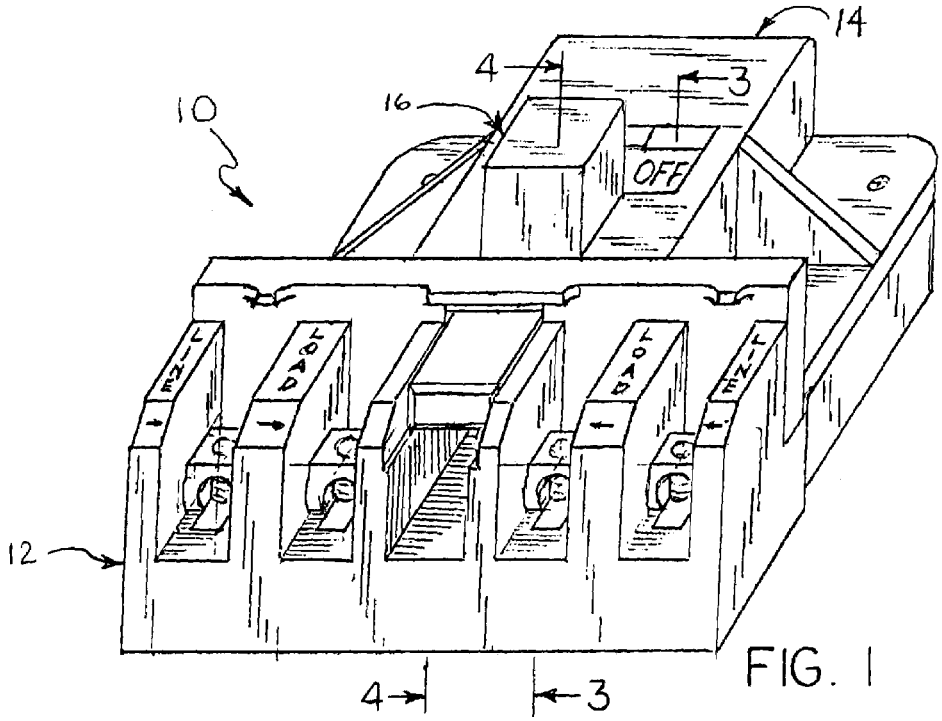
FIG. 1 is a diagrammatic perspective view of the present invention.

10 non-fused electrical slide switch of present invention
12 base
14 cover
16 handle assembly
18 floor of base 12
20 six partitions of base 12
22 hump of base 12
24 four contact strips of base 12
25 four contact terminals of base 12
26 uppermost surface of floor 18 of base 12
28 rearwardmost boundary of floor 18 of base 12
30 forwardmost boundary of floor 18 of base 12
31 pair of sidewardmost boundaries of floor 18 of base 12
32 longitudinal centerline of floor 18 of base 12
34 spaces between adjacent pairs of six partitions 20 of base 12
37 rearwardmost boundaries of four outermost partitions of six partitions 20 of base 12
38 rearwardmost boundary of hump 22 of base 12
39 blind bores in rearwardmost boundaries 37 of four outermost partitions of six partitions 20 of base 12
40 uppermost boundary of hump 22 of base 12
42 through bore through rearwardmost boundary 38 of hump 22 of base 12
44 pair of dimpled blind bore wells in uppermost boundary 40 of hump 22 of base 12
46 four recesses in uppermost surface 26 of floor 18 of base 12
48 two pair of raised landings on uppermost surface 26 of floor 18 of base 12
50 floor of cover 14
52 wall of cover 14
54 hump of cover 14
56 uppermost surface of floor 50 of cover 14
58 rearwardmost boundary of floor 50 of cover 14
60 forwardmost boundary of floor 50 of cover 14
61 pair of sidewardmost boundaries of floor 50 of cover 14
62 longitudinal centerline of floor 50 of cover 14
64 forwardmost surface of wall 52 of cover 14
66 uppermost boundary of wall 52 of cover 14
68 lowermost boundary of wall 52 of cover 14
69 centerline of wall 52 of cover 14
70 through bore in wall 52 of cover 14
72 first portion of through bore 70 in wall 52 of cover 14
74 second portion of through bore 70 in wall 52 of cover 14
76 four tabs extending forwardly from forwardmost surface 64 of wall 52 of cover 14

78 rearwardmost boundary of hump 54 of cover 14
80 uppermost boundary of hump 54 of cover 14
82 two spaced-apart portions of floor 50 of cover 14
84 tab extending inwardly from forwardmost surface 86 of rearwardmost boundary 78 of hump 54 of cover 14
86 forwardmost surface of rearwardmost boundary 78 of hump 54 of cover 14
88 lowermost boundary of rearwardmost boundary 78 of hump 54 of cover 14
90 T-shaped through bore in uppermost boundary 80 of hump 54 of cover 14
92 body of handle assembly 16
94 head of handle assembly 16
96 nose of handle assembly 16
98 pair of feet of handle assembly 16
99 shoe assembly of handle assembly 16
100 sole of each foot of pair of feet of handle assembly 16
101 lock assembly of handle assembly 16
102 toe of sole 100 of each foot of pair of feet 98 of handle assembly 16
104 heel of sole 100 of each foot of pair of feet 98 of handle assembly 16
106 uppermost surface of body 92 of handle assembly 16
108 lowermost surface of body 92 of handle assembly 16
110 forwardmost boundary of body 92 of handle assembly 16
112 rearwardmost boundary of body 92 of handle assembly 16
114 pair of sidewardmost boundaries of body 92 of handle assembly 16
115 longitudinal centerline of body 92 of handle assembly 16
116 forwardmost boundary of head 94 of handle assembly 16
118 free end of nose 96 of handle assembly 16
120 pair of contact shoes of shoe assembly 99
122 at least one pair of springs of shoe assembly 99
124 at least one blind bore in sole 100 of each foot of pair of feet 98 of handle assembly 16
126 depending portions of each contact shoe of pair of contact shoes 120 of shoe assembly 99
128 space between depending portions 126 of each contact shoe of pair of contact shoes 120 of shoe assembly 99
130 plunger of lock assembly 101
132 spring of lock assembly 101
134 blind bore in lowermost surface 108 of body 92 of handle assembly 16

DETAILED DESCRIPTION OF THE PREFERRED EMBODIMENT

Referring now to the figures, in which like numerals indicate like parts, and particularly to FIG. 1, the non-fused electrical slide switch of the present invention is shown generally at 10, and comprises a base 12, a cover 14, and a handle assembly 16. The handle assembly 16 is operatively connected to the base 12 between on and off positions and movable relative to the cover 14.

Figure 2A:
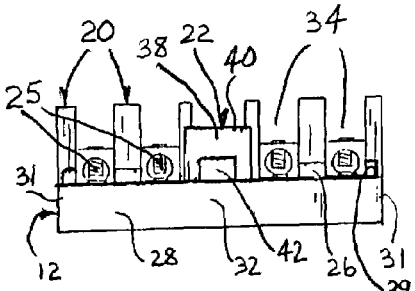
FIG. 2A is a diagrammatic rear elevational view taken generally in the direction of ARROW 2A in FIG. 2 of the base of the present invention shown in FIGS. 1 and 2.
Figure 2:
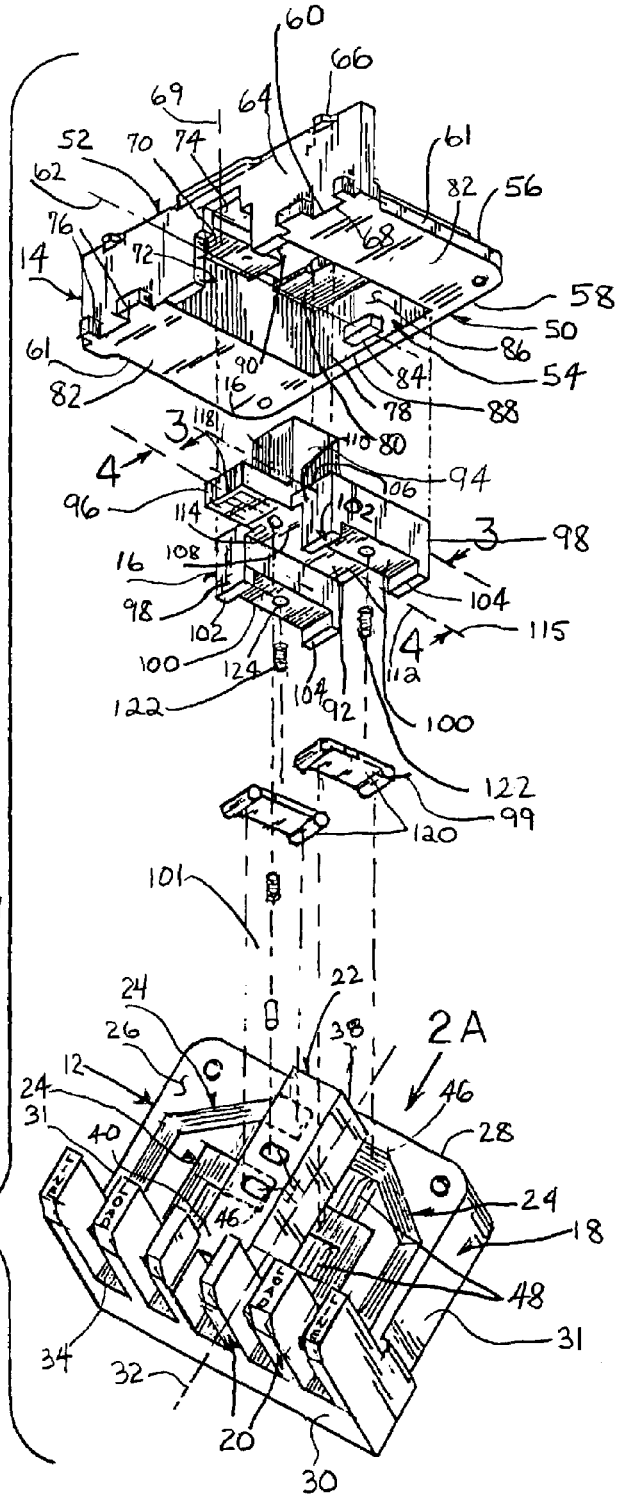
FIG. 2 is an exploded diagrammatic oblique perspective view of the present invention shown in FIG. 1.

The specific configuration of the base 12 can best be seen in FIGS. 2 and 2A, and as such, will be discussed with reference thereto.

The base 12 has a floor 18, six partitions 20, a hump 22, four contact strips 24, and four contact terminals 25.

The floor 18 of the base 12 is generally planar, and has an uppermost surface 26, a rearwardmost boundary 28, a forwardmost boundary 30, a pair of sidewardmost boundaries 31, and a longitudinal centerline 32.

The six partitions 20 of the base 12 are generally planar, extend vertically upwardly from the uppermost surface 26 of the floor 18 of the base 12, along the forwardmost boundary 30 of the floor 18 of the base 12, from one sidewardmost boundary 31 of the floor 18 of the base 12 to the other sidewardmost boundary 31 of the floor 18 of the base 12, and are spaced-apart from each other so as to form spaces 34 between adjacent pairs thereof for the four contact terminals 25.

The four contact terminals 25 are divided into outermost ones that are line terminals and innermost ones that are load terminals.

Four outermost partitions of the six partitions 20 of the base 12 have rearwardmost boundaries 37 that contain blind bores 39 that extend upwardly from the uppermost surface 26 of the floor 18 of the base 12 to partially therealong.

The hump 22 of the base 12 is generally rectangular-parallelepiped-shaped, has a rearwardmost boundary 38 and an uppermost boundary 40, extends along the longitudinal centerline 32 of the floor 18 of the base 12, from just forward of the rearwardmost boundary 28 of the floor 18 of the base 12 to contact with an innermost pair of the six partitions 20 of the base 12, and divides the four contact terminals 25 into two pairs, each having one line and one load contact terminal.

The rearwardmost boundary 38 of the hump 22 of the base 12 has a through bore 42 therethrough that extends upwardly from the uppermost surface 26 of the floor 18 of the base 12 to short of the uppermost boundary 40 of the hump 22 of the base 12.

The uppermost boundary 40 of the hump 22 of the base 12 has a pair of dimpled blind bore wells 44 therein that are spaced longitudinally therealong and which are disposed generally centrally therealong.

The uppermost surface 26 of the floor 18 of the base 12 has four recesses 46 therein. The four recesses 46 in the uppermost surface 26 of the floor 18 of the base 12 are divided into outermost ones that are line recesses and innermost ones that are load recesses, and which are divided by the hump 22 of the base 12 into two pairs, each having one line and one load recess.

One line recess of the four recesses 46 in the uppermost surface 26 of the floor 18 of the base 12 extends from one line terminal of the four contact terminals 25 rearwardly and sidewardly to one side of the hump 22 of the base 12, just forward of the rearwardmost boundary 38 of the hump 22 of the base 12, and the other line recess of the four recesses 46 in the uppermost surface 26 of the floor 18 of the base 12 extends from the other line terminal of the four contact terminals 25 rearwardly and sidewardly to the other side of the hump 22 of the base 12, just forward of the rearwardmost boundary 38 of the hump 22 of the base 12.

One load recess of the four recesses 46 in the uppermost surface 26 of the floor 18 of the base 12 extends from one load terminal of the four contact terminals 25 rearwardly and sidewardly to the one side of the hump 22 of the base 12, in line with intermediate the pair of dimpled blind bore wells 44 in the uppermost boundary 40 of the hump 22 of the base 12, and the other load recess of the four recesses 46 in the uppermost surface 26 of the floor 18 of the base 12 extends from the other load terminal of the four contact terminals 25 rearwardly and sidewardly to the other side of the hump 22 of the base 12, in line with intermediate the pair of dimpled blind bore wells 44 in the uppermost boundary 40 of the hump 22 of the base 12.

The four contact strips 24 of the base 12 fill the four recesses 46 in the uppermost surface 26 of the floor 18 of the base 12 and electrically communicate with the four contact terminals 25, respectively.

The uppermost surface 26 of the floor 18 of the base 12 further has two pair of raised landings 48 that rise above the four contact strips 24 of the base 12.

One pair of the two pair of raised landings 48 on the uppermost surface 26 of the floor 18 of the base 12 are disposed adjacent one side of the hump 22 of the base 12. One of the one pair of the two pair of raised landings 48 is disposed between one load contact strip and one line contact strip of the four contact strips 24 and the other of the one pair of the two pair of raised landings 48 is disposed between the one load contact of the four contact strips 24 and the six partitions 20 of the base 12.

The other pair of the two pair of raised landings 48 on the uppermost surface 26 of the floor 18 of the base 12 are disposed adjacent the other side of the hump 22 of the base 12. One of the other pair of the two pair of raised landings 48 is disposed between the other load contact strip and the other line contact strip of the four contact strips 24 and the other of the other pair of the two pair of raised landings 48 is disposed between the other load contact of the four contact strips 24 and the six partitions 20 of the base 12.

The specific configuration of the cover 14 can best be seen in FIG. 2, and as such, will be discussed with reference thereto.

The cover 14 has a floor 50, a wall 52, and a hump 54.

The floor 50 of the cover 14 is generally planar and has an uppermost surface 56, a rearwardmost boundary 58, a forwardmost boundary 60, a pair of sidewardmost boundaries 61, and a longitudinal centerline 62.

The wall 52 of the cover 14 is generally planar, and extends vertically upwardly from the uppermost surface 56 of the floor 50 of the cover 14, along the forwardmost boundary 60 of the floor 50 of the cover 14, from one sidewardmost boundary 61 of the floor 50 of the cover 14 to the other sidewardmost boundary 61 of the floor 50 of the cover 14.

The wall 52 of the cover 14 has a forwardmost surface 64, an uppermost boundary 66, a lowermost boundary 68, and a centerline 69.

The wall 52 of the cover 14 further has a through bore 70 that extends upwardly along the centerline 69 of the wall 52 of the cover 14 in a first portion 72 from the lowermost boundary 68 of the wall 52 of the cover 14 to a second portion 74 that extends upwardly therefrom to just short of the uppermost boundary 66 of the wall 52 of the cover 14.

The first portion 72 of the through bore 70 in the wall 52 of the cover 14 communicates with, and is wider than, the second portion 74 of the through bore 70 in the wall 52 of the cover 14, and is sized to have the hump 22 of the base 18 fit nicely therethrough.

The forwardmost surface 64 of the wall 52 of the cover 14 has four tabs 76 that extend forwardly therefrom, along the lowermost boundary 68 of the wall 52 of the cover 14, and are so positioned so as to be replaceably received within the blind bores 39 in the rearwardmost boundaries 37 of the four outermost partitions of the six partitions 20 of the base 12, respectively.

The hump 54 of the cover 14 is generally rectangular-parallelepiped-shaped, with an inverted U-shape in lateral cross section.

The hump 54 of the cover 14 has a rearwardmost boundary 78, an uppermost boundary 80, a partially open front, and an open bottom.

The hump 54 of the cover 14 extends along the longitudinal centerline 62 of the floor 50 of the cover 14, from the rearwardmost boundary 58 of the floor 50 of the cover 14 to contact with the wall 52 of the cover 14, and communicates with the through bore 70 in the wall 52 of the cover 14 by virtue of its partially open front and communicates with the floor 50 of the cover 14 by virtue of its open bottom, and in so doing, divides the floor 50 of the cover 14 into two spaced-apart portions 82 that allow the hump 22 of the base 12 to be replaceably positioned therebetween.

The rearwardmost boundary 78 of the hump 54 of the cover 14 has a tab 84 extending inwardly from a forwardmost surface 86 thereof, just above a lowermost boundary 88 thereof, and is replaceably received within the through bore 42 in the rearwardmost boundary 38 of the hump 22 of the base 12.

The uppermost boundary 80 of the hump 54 of the cover 14 has a T-shaped through bore 90, whose lateral portion extends generally centrally thereacross and whose axial portion extends forwardly from the lateral portion thereof to the wall 52 of the cover 14 and which communicates with the second portion 74 of the through bore 70 in the wall 52 of the cover 14.

The specific configuration of the handle assembly 16 can best be seen in FIG. 2, and as such, will be discussed with reference thereto.

The handle assembly 16 has body 92, a head 94, a nose 96, a pair of feet 98, a shoe assembly 99, and a lock assembly 101.

Each foot 98 of the handle assembly 16 has a sole 100 with a toe 102 depending from a forwardmost end thereof and a heel 104 depending from a rearwardmost end thereof.

The body 92 of the handle assembly 16 is generally rectangular-parallelepiped-shaped, and has an uppermost surface 106, a lowermost surface 108, a forwardmost boundary 110, a rearwardmost boundary 112, a pair of sidewardmost boundaries 114, and a longitudinal centerline 115, and rides longitudinally along the uppermost boundary 40 of the hump 22 of the base 12.

The head 94 of the handle assembly 16 has a forwardmost boundary 116, and extends upwardly from the uppermost surface 106 of the body 92 of the handle assembly 16, rearwardly from the forwardmost boundary 110 of the body 92 of the handle assembly 16 to a distance substantially midway along the longitudinal centerline 115 of the body 92 of the handle assembly 16, and moves longitudinally through the axial portion of the T-shaped through bore 90 in the uppermost boundary 80 of the hump 54 of the cover 14.

The uppermost surface 106 of the body 92 of the handle assembly 16 has "ON" and "OFF" indicia thereon that are so positioned so as to be visible through the lateral portion of the T-shaped through bore 90 in the uppermost boundary 80 of the hump 54 of the cover 14 when the head 94 of the handle assembly 16 is in an associated on/off position.

The nose 96 of the handle assembly 16 is generally rectangular-parallelepiped-shaped, extends forwardly from the forwardmost boundary 116 of the body 92 of the handle assembly 16, collinear with the longitudinal centerline 115 of the body 92 of the handle assembly 16, to a free end 118, and moves longitudinally through the second portion 74 of the through bore 70 in the wall 52 of the cover 14.

The pair of feet of the handle assembly 16 are rectangular-parallelepiped-shaped and depend from the sidewardmost boundaries 114 of the body 92 of the handle assembly 16, respectively, from the forwardmost boundary 110 of the body 92 of the handle assembly 16 to the rearwardmost boundary 112 of the body 92 of the handle assembly 16.

Figure 3:
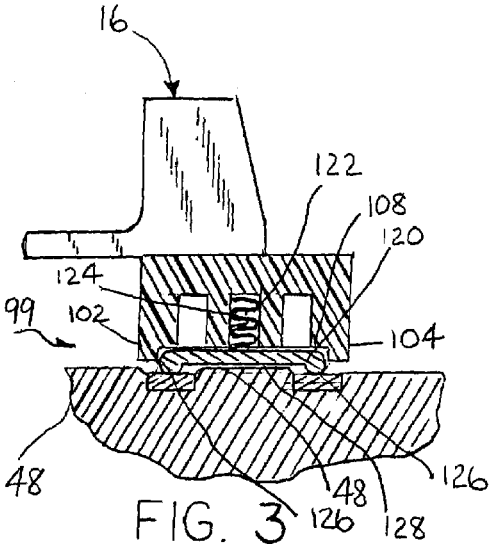
FIG. 3 is a diagrammatic cross sectional view taken along LINE 3—3 in FIG. 1, but in the on position, and along LINE 3—3 in FIG. 2 of the contact portion of the handle assembly of the present invention shown in FIGS. 1 and 2.

The specific shoe assembly 99 can best be seen in FIGS. 2 and 3, and as such, will be discussed with reference thereto.

The shoe assembly 99 comprises a pair of contact shoes 120 and at least one pair of springs 122.

The sole 100 of each foot 98 of the handle assembly 16 has at least one blind bore 124 in which an associated spring 122 is disposed.

The pair of contact shoes 120 of the shoe assembly 99 abut the sole 100 of each foot 98 of the handle assembly 16, respectively, are prevented from forward movement relative thereto by the toe 102 of the sole 100 of each foot 98 of the handle assembly 16, are prevented from rearward movement relative thereto by the heel 104 of the sole 100 of each foot 98 of the handle assembly 16, and are biased away therefrom by the at least one pair of springs 122 of the shoe assembly 99 abutting thereagainst.

Each contact shoe 120 of the shoe assembly 99 has depending portions 126 at forwardmost and rearwardmost boundaries thereof that define a space 128 therebetween.

The depending portions 126 of each contact shoe 120 of the shoe assembly 99 are in direct contact with an associated load contact strip and line contact strip of the four contact strips 24 so as to allow electrically communication therebetween when the handle assembly 16 is in the on position thereof.

The two pair of raised landings 48 prevent arcing as the handle assembly 16 traverses the on/off positions by raising the depending portions 126 of each contact shoe 120 of the shoe assembly 99 immediately after they leave contact with the associated load contact strip and line contact strip of the four contact strips 24 and thereby cause a quick break in electrical communication therebetween.

Conversely the same two pair of raised landings 48 also prevent arcing as the handle assembly 16 traverses the on/off positions by lowering the depending portions 126 of each contact shoe 120 of the shoe assembly 99 immediately before they join contact with the associated load contact strip and line contact strip of the four contact strips 24 and thereby cause a quick make in electrical communication therebetween.

Figure 4:
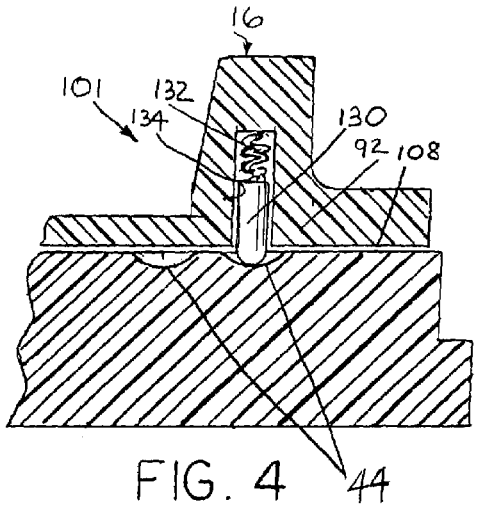
FIG. 4 is a diagrammatic cross sectional view taken along LINE 4—4 in FIG. 1 and along LINE 4—4 in FIG. 2, but in the off position of the lock portion of the handle assembly of the present invention shown in FIGS. 1 and 2.

The specific configuration of the lock assembly 101 can best be seen in FIG. 4, and as such, will be discussed with reference thereto.

The lock assembly 101 comprises a plunger 130 and a spring 132.

The lowermost surface 108 of the body 92 of the handle assembly 16 has a blind bore 134. The spring 132 of the lock assembly 101 and the plunger 130 of the lock assembly 101 sit in the blind bore 134 in the lowermost surface 108 of the body 92 of the handle assembly 16.

The plunger 130 of the lock assembly 101 is biased outwardly from the blind bore 134 in the lowermost surface 108 of the body 92 of the handle assembly 16 by the spring 132 of the lock assembly 101 into one of the pair of dimpled blind bore wells 44 in the uppermost boundary 40 of the hump 22 of the base 12 so as to lock the handle assembly 16 in a respective one of its on/off positions, and in so doing, a large force is required to move the handle assembly 16 so as to impart a quick movement to the contact shoes 120 of the shoe assembly 99 which assists in the arc prevention during movement thereof.

Figure 5:
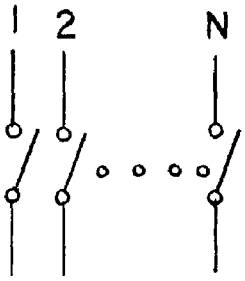
FIG. 5 is a schematic diagram of the present invention indicating that any number of circuits can be controlled simultaneously by the present invention.

As shown in FIG. 5, more than two, and generally any number N of circuits can be controlled simultaneously by the present invention.

It will be understood that each of the elements described above, or two or more together, may also find a useful application in other types of constructions differing from the types described above.

While the invention has been illustrated and described as embodied in a non-fused electrical slide switch, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A non-fused electrical slide switch, comprising:

a) a base;

b) a cover; and c) a handle assembly;

wherein said handle assembly is operatively connected to said base, between on and off positions; and wherein said handle assembly is movable relative to said cover, wherein said base has a floor;

wherein said base has six partitions;

wherein said base has a hump;

wherein said base has four contact strips; and wherein said base has four contact terminals, wherein said floor of said base has an uppermost surface;

wherein said floor of said base has a rearwardmost boundary;

wherein said floor of said base has a forwardmost boundary;

wherein said floor of said base has a pair of sidewardmost boundaries; and wherein said floor of said base has a longitudinal centerline, wherein said four contact terminals are divided into outermost ones that are line terminals and innermost ones that are load terminals, wherein four outermost partitions of said six partitions of said base have rearwardmost boundaries;

wherein said rearwardmost boundaries of said four outermost partitions of said six partitions of said base contain blind bores; and wherein said blind bores in said rearwardmost boundaries of said four outermost partitions of said six partitions of said base extend upwardly from said uppermost surface of said floor of said base to partially therealong.

2. The switch as defined in claim 1, wherein said floor of said base is generally planar.

3. The switch as defined in claim 1, wherein said six partitions of said base are generally planar.

4. The switch as defined in claim 1, wherein said six partitions of said base extend vertically upwardly from said uppermost surface of said floor of said base;

wherein said six partitions of said base extend along said forwardmost boundary of said floor of said base;

wherein said six partitions of said base extend from one sidewardmost boundary of said floor of said base to the other sidewardmost boundary of said floor of said base; and wherein said six partitions of said base are spaced-apart from each other so as to form spaces between adjacent pairs thereof in which said four contact terminals of said base are disposed, respectively.

5. The switch as defined in claim 1, wherein said hump of said base is generally rectangular-parallelepiped-shaped.

6. The switch as defined in claim 1, wherein said hump of said base has a rearwardmost boundary;

wherein said hump of said base has an uppermost boundary;

wherein said hump of said base extends along said longitudinal centerline of said floor of said base;

wherein said hump of said base extends from just forward of said rearwardmost boundary of said floor of said base to contact with an innermost pair of said six partitions of said base;

wherein said hump of said base divides said four contact terminals of said base into two pairs; and wherein each of said two pairs of said four contact terminals of said base has one line and one load contact terminal.

7. The switch as defined in claim 6, wherein said rearwardmost boundary of said hump of said base has a through bore; and wherein said through bore in said rearwardmost boundary of said hump of said base extends upwardly from said uppermost surface of said floor of said base to short of said uppermost boundary of said hump of said base.

8. The switch as defined in claim 7, wherein said rearwardmost boundary of said hump of said cover has a tab;

wherein said tab extends inwardly from a forwardmost surface of said rearwardmost boundary of said hump of said cover;

wherein said tab extends just above a lowermost boundary of said rearwardmost boundary of said hump of said cover; and wherein said tab is replaceably received within said through bore in said rearwardmost boundary of said hump of said base.

9. The switch as defined in claim 6, wherein said uppermost boundary of said hump of said base has a pair of dimpled blind bore wells;

wherein said pair of dimpled blind bore wells are spaced longitudinally along said uppermost boundary of said hump of said base; and wherein said pair of dimpled blind bore wells are disposed generally centrally on said uppermost boundary of said hump of said base.

10. The switch as defined in claim 9, wherein said uppermost surface of said floor of said base has four recesses;

wherein said four recesses in said uppermost surface of said floor of said base are divided into outermost ones that are line recesses and innermost ones that are load recesses;

wherein said four recesses in said uppermost surface of said floor of said base are divided by said hump of said base into two pairs; and each of said two pairs of said four recesses in said uppermost surface of said floor of said base has one line and one load recess.

11. The switch as defined in claim 10, wherein one line recess of said four recesses in said uppermost surface of said floor of said base extends from one line terminal of said four contact terminals rearwardly and sidewardly to one side of said hump of said base, just forward of said rearwardmost boundary of said hump of said base; and wherein the other line recess of said four recesses in said uppermost surface of said floor of said base extends from the other line terminal of said four contact terminals rearwardly and sidewardly to the other side of said hump of said base, just forward of said rearwardmost boundary of said hump of said base.

12. The switch as defined in claim 10, wherein one load recess of said four recesses in said uppermost surface of said floor of said base extends from one load terminal of said four contact terminals rearwardly and sidewardly to said one side of said hump of said base, in line with intermediate said pair of dimpled blind bore wells in said uppermost boundary of said hump of said base; and wherein the other load recess of said four recesses in said uppermost surface of said floor of said base extends from the other load terminal of said four contact terminals rearwardly and sidewardly to said other side of said hump of said base, in line with intermediate said pair of dimpled blind bore wells in said uppermost boundary of said hump of said base.

13. The switch as defined in claim 10, wherein said four contact strips of said base fill said four recesses in said uppermost surface of said floor of said base, respectively, and electrically communicate with said four contact terminals of said base, respectively.

14. The switch as defined in claim 9, wherein said uppermost surface of said floor of said base has two pair of raised landings; and wherein said two pair of raised landings of said uppermost surface of said floor of said base rise above said four contact strips of said base.

15. The switch as defined in claim 14, wherein one pair of said two pair of raised landings on said uppermost surface of said floor of said base are disposed adjacent one side of said hump of said base.

16. The switch as defined in claim 15, wherein one of said one pair of said two pair of raised landings is disposed between one load contact strip and one line contact strip of said four contact strips; and wherein the other of said one pair of said two pair of raised landings is disposed between said one load contact of said four contact strips and said six partitions of said base.

17. The switch as defined in claim 16, wherein the other pair of said two pair of raised landings on said uppermost surface of said floor of said base are disposed adjacent the other side of said hump of said base.

18. The switch as defined in claim 17, wherein one of said other pair of said two pair of raised landings is disposed between the other load contact strip and the other line contact strip of said four contact strips and the other of said other pair of said two pair of raised landings is disposed between said other load contact of said four contact strips and said six partitions of said base.

19. The switch as defined in claim 16, wherein said cover has a floor;

wherein said cover has a wall; and wherein said cover has a hump.

20. The switch as defined in claim 19, wherein said floor of said cover is generally planar.

21. The switch as defined in claim 19, wherein said floor of said cover has an uppermost surface;

wherein said floor of said cover has a rearwardmost boundary;

wherein said floor of said cover has a forwardmost boundary;

wherein said floor of said cover has a pair of sidewardmost boundaries; and wherein said floor of said cover has a longitudinal centerline.

22. The switch as defined in claim 19, wherein said wall of said cover is generally planar.

23. The switch as defined in claim 19, wherein said wall of said cover extends vertically upwardly from said uppermost surface of said floor of said cover;

wherein said wall of said cover extends along said forwardmost boundary of said floor of said cover; and wherein said wall of said cover extends from one sidewardmost boundary of said floor of said cover to the other sidewardmost boundary of said floor of said cover.

24. The switch as defined in claim 19, wherein said wall of said cover has a forwardmost surface;

wherein said wall of said cover has an uppermost boundary;

wherein said wall of said cover has a lowermost boundary; and wherein said wall of said cover has a centerline.

25. The switch as defined in claim 24, wherein said wall of said cover has a through bore; and wherein said through bore extends upwardly along said centerline of said wall of said cover in a first portion from said lowermost boundary of said wall of said cover to a second portion that extends upwardly therefrom to just short of said uppermost boundary of said wall of said cover.

26. The switch as defined in claim 25, wherein said first portion of said through bore in said wall of said cover communicates with said second portion of said through bore in said wall of said cover;

wherein said first portion of said through bore in said wall of said cover is wider than said second portion of said through bore in said wall of said cover; and wherein said first portion of said through bore in said wall of said cover is sized to have said hump of said base fit nicely therethrough.

27. The switch as defined in claim 25, wherein said hump of said cover extends along said longitudinal centerline of said floor of said cover;

wherein said hump of said cover extends from said rearwardmost boundary of said floor of said cover to contact with said wall of said cover;

wherein said hump of said cover communicates with said through bore in said wall of said cover by virtue of its partially open front; and wherein said hump of said cover communicates with said floor of said cover by virtue of its open bottom, and in so doing, divides said floor of said cover into two spaced-apart portions that allow said hump of said base to be replaceably positioned therebetween.

28. The switch as defined in claim 25, wherein said uppermost boundary of said hump of said cover has a T-shaped through bore, whose lateral portion extends generally centrally thereacross and whose axial portion extends forwardly from said lateral portion thereof to said wall of said cover and communicates with said second portion of said through bore in said wall of said cover.

29. The switch as defined in claim 28, wherein said handle assembly has body;

wherein said handle assembly has a head;

wherein said handle assembly has a nose;

wherein said handle assembly has a pair of feet;

wherein said handle assembly has a shoe assembly; and wherein said handle assembly has a lock assembly.

30. The switch as defined in claim 29, wherein each foot of said handle assembly has a sole;

wherein said sole of each foot of said handle assembly has a forwardmost end;

wherein said sole of each foot of said handle assembly has a toe;

wherein said toe of said sole of each foot of said handle assembly depends from said forwardmost end thereof;

wherein said sole of each foot of said handle assembly has a rearwardmost end;

wherein said sole of each foot of said handle assembly has a heel; and wherein said heel of said sole of each foot of said handle assembly depends from said rearwardmost end thereof.

31. The switch as defined in claim 30, wherein said shoe assembly comprises a pair of contact shoes; and wherein said shoe assembly comprises at least one pair of springs.

32. The switch as defined in claim 31, wherein said sole of each foot of said handle assembly has at least one blind bore; and wherein an associated spring of said shoe assembly is disposed in said at least one blind bore in said sole of each foot of said handle assembly.

33. The switch as defined in claim 31, wherein said pair of contact shoes of said shoe assembly abut said sole of each foot of said handle assembly, respectively;

wherein said pair of contact shoes of said shoe assembly are prevented from forward movement relative to said sole of each foot of said handle assembly, respectively, by said toe of said sole of each foot of said handle assembly;

wherein said pair of contact shoes of said shoe assembly are prevented from rearward movement relative to said sole of each foot of said handle assembly, respectively, by said heel of said sole of each foot of said handle assembly; and wherein said pair of contact shoes of said shoe assembly are biased away from said sole of each foot of said handle assembly by said at least one pair of springs of said shoe assembly abutting thereagainst.

34. The switch as defined in claim 31, wherein each contact shoe of said shoe assembly has depending portions at forwardmost and rearwardmost boundaries thereof; and wherein said depending portions of each contact shoe of said shoe assembly define a space therebetween.

35. The switch as defined in claim 34, wherein said depending portions of each contact shoe of said shoe assembly are in direct contact with an associated load contact strip and line contact strip of said four contact strips so as to allow electrically communication therebetween when said handle assembly is in said on position thereof.

36. The switch as defined in claim 35, wherein said two pair of raised landings prevent arcing as said handle assembly traverses said on/off positions by raising said depending portions of each contact shoe of said shoe assembly immediately after they leave contact with said associated load contact strip and line contact strip of said four contact strips and thereby cause a quick break in electrical communication.

37. The switch as defined in claim 35, wherein said two pair of raised landings prevent arcing as said handle assembly traverses said on/off positions by lowering said depending portions of each contact shoe of said shoe assembly immediately before they join contact with said associated load contact strip and line contact strip of said four contact strips and thereby cause a quick make in electrical communication.

38. The switch as defined in claim 29, wherein said body of said handle assembly is generally rectangular-parallelepiped-shaped.

39. The switch as defined in claim 29, wherein said body of said handle assembly has an uppermost surface;

wherein said body of said handle assembly has a lowermost surface;

wherein said body of said handle assembly has a forwardmost boundary;

wherein said body of said handle assembly has a rearwardmost boundary;

wherein said body of said handle assembly has a pair of sidewardmost boundaries;

wherein said body of said handle assembly has a longitudinal centerline; and wherein said body of said handle assembly rides longitudinally along said uppermost boundary of said hump of said base.

40. The switch as defined in claim 39, wherein said head of said handle assembly has a forwardmost boundary;

wherein said head of said handle assembly extends upwardly from said uppermost surface of said body of said handle assembly;

wherein said head of said handle assembly extends rearwardly from said forwardmost boundary of said body of said handle assembly to a distance substantially midway along said longitudinal centerline of said body of said handle assembly; and wherein said head of said handle assembly moves longitudinally through said axial portion of said T-shaped through bore in said uppermost boundary of said hump of said cover.

41. The switch as defined in claim 39, wherein said uppermost surface of said body of said handle assembly has "ON" and "OFF" indicia thereon; and wherein said "ON" and "OFF" indicia on said uppermost surface of said body of said handle assembly are so positioned so as to be visible through said lateral portion of said T-shaped through bore in said uppermost boundary of said hump of said cover when said head of said handle assembly is in an associated on/off position.

42. The switch as defined in claim 39, wherein said nose of said handle assembly extends forwardly from said forwardmost boundary of said body of said handle assembly to a free end;

wherein said nose of said handle assembly is collinear with said longitudinal centerline of said body of said handle assembly; and wherein said nose of said handle assembly moves longitudinally through said second portion of said through bore in said wall of said cover.

43. The switch as defined in claim 29, wherein said pair of feet of said handle assembly are rectangular-parallelepiped-shaped.

44. The switch as defined in claim 39, wherein said lock assembly comprises a plunger; and wherein said lock assembly comprises a spring.

45. The switch as defined in claim 44, wherein said lowermost surface of said body of said handle assembly has a blind bore.

46. The switch as defined in claim 45, wherein said spring of said lock assembly and said plunger of said lock assembly sit in said blind bore in said lowermost surface of said body of said handle assembly.

47. The switch as defined in claim 44, wherein said plunger of said lock assembly is biased outwardly from said blind bore in said lowermost surface of said body of said handle assembly by said spring of said lock assembly into one of said pair of dimpled blind bore wells in said uppermost boundary of said hump of said base so as to lock said handle assembly in a respective one of its on/off positions, and in so doing, a large force is required to move said handle assembly so as to impart a quick movement to said contact shoes of said shoe assembly which assists in the arc prevention during movement thereof.

48. The switch as defined in claim 29, wherein said nose of said handle assembly is generally rectangular-parallelepiped-shaped.

49. The switch as defined in claim 39, wherein said pair of feet of said handle assembly depend from said sidewardmost boundaries of said body of said handle assembly, respectively; and wherein said pair of feet of said handle assembly extend from said forwardmost boundary of said body of said handle assembly to said rearwardmost boundary of said body of said handle assembly.

50. The switch as defined in claim 24, wherein said forwardmost surface of said wall of said cover has four tabs;

wherein said four tabs extend forwardly from said forwardmost surface of said wall of said cover;

wherein said four tabs extend along said lowermost boundary of said wall of said cover; and wherein said four tabs are so positioned so as to be replaceably received within said blind bores in said rearwardmost boundaries of said four outermost partitions of said six partitions of said base, respectively.

51. The switch as defined in claim 19, wherein said hump of said cover is generally rectangular-parallelepiped-shaped; and wherein said hump of said cover has an inverted U-shaped in lateral cross section.

52. The switch as defined in claim 19, wherein said hump of said cover has a rearwardmost boundary;

wherein said hump of said cover has an uppermost boundary;

wherein said hump of said cover has a partially open front; and wherein said hump of said cover has an open bottom.

* * * * *